US006769386B2

(12) United States Patent
Shafer et al.

(10) Patent No.: US 6,769,386 B2
(45) Date of Patent: Aug. 3, 2004

(54) ADJUSTING ELEMENT FOR A ROTARY PISTON

(75) Inventors: Jens Shafer, Herzogenaurach (DE); Martin Steigerwald, Herzogenaurach (DE); Dieter Neller, Hirschaid (DE)

(73) Assignee: Ina-Schaeffler KG (DE)

( * ) Notice: Subject to any disclaimer, the term of this patent is extended or adjusted under 35 U.S.C. 154(b) by 155 days.

(21) Appl. No.: 10/168,366

(22) PCT Filed: Nov. 30, 2000

(86) PCT No.: PCT/EP00/11990

§ 371 (c)(1),
(2), (4) Date: Jul. 9, 2002

(87) PCT Pub. No.: WO01/44628

PCT Pub. Date: Jun. 21, 2001

(65) Prior Publication Data

US 2004/0020455 A1 Feb. 5, 2004

(30) Foreign Application Priority Data

Dec. 18, 1999 (DE) ..... 199 61 192

(51) Int. Cl.[7] ..... F01L 1/34

(52) U.S. Cl. ..... 123/90.17; 123/90.15; 464/2; 464/161; 464/169; 92/121; 92/124

(58) Field of Search ..... 123/90.15–90.18, 123/90.27, 90.31; 464/1, 2, 5, 160, 161, 169; 92/67, 68, 69 R, 71, 120–125, 132; 267/248, 249, 255

(56) References Cited

U.S. PATENT DOCUMENTS 5,829,398 A * 11/1998 Strauss et al. ..... 123/90.17
5,836,277 A * 11/1998 Kira et al. ..... 123/90.17
6,651,600 B1 * 11/2003 Schafer et al. ..... 123/90.17

FOREIGN PATENT DOCUMENTS

| | | |
|---|---|---|
| DE | 19854891 | 6/1999 |
| EP | 52037616 | 3/1977 |
| EP | 61001833 | 1/1986 |
| EP | 0915234 | 5/1999 |
| EP | 11173118 | 6/1999 |

* cited by examiner

*Primary Examiner*—Thomas Denion
*Assistant Examiner*—Kyle M. Riddle
(74) *Attorney, Agent, or Firm*—Muserlian, Lucas and Mercanti

(57) ABSTRACT

The invention concerns a rotary piston adjuster for adjusting the angular position of the camshaft of an internal combustion engine, said adjuster comprising an outer rotor having at least one hydraulic chamber, and an inner rotor comprising at least one pivoting vane that can pivot hydraulically in the hydraulic chamber between a retard stop position and an advance stop position. A locking device suitable for detachably connecting the outer and inner rotors to each other and at least one compression spring acting in opposition to the frictional torque of the camshaft are arranged between the two rotors.

A liberal design of the compression spring and a low-wear operation with this spring are enabled by the fact that the compression spring (27, 27') is arranged in an attachment (4) that is connected to the rotary piston adjuster, and the components of the attachment have a wear-resistant configuration and support the compression spring (27, 27') at least pointwise over its entire length.

8 Claims, 3 Drawing Sheets

ADJUSTING ELEMENT FOR A ROTARY PISTON

FIELD OF THE INVENTION

The invention concerns a rotary piston adjuster for adjusting the angular position of the camshaft of an internal combustion engine, particularly according to the preamble of claim 1.

BACKGROUND OF THE INVENTION

The camshaft, and the entire valve train of the internal combustion engine possesses a frictional torque that acts in opposition to its driving torque and tends to shift the rotary piston adjuster in a direction of retard. This intensifies its retarding adjustment and hinders its advancing adjustment and thus leads to different adjusting speeds in advance and retard directions. Further, locking and unlocking of the rotary piston adjuster are influenced by the frictional torque of the camshaft. Due to the retarding adjustment favored by friction, adjusters of the exhaust camshaft that lock in an advance position have a tendency to make the locking element clamp when it is unlocked. The reason for this is that the frictional torque of the camshaft and the oil pressure of the working chamber A required for unlocking, load the locking element prior to unlocking in a direction leading away from the advance stop toward the retard stop and cause it to clamp.

Unlocking in the retard position is uncritical especially if the frictional torque of the camshaft acting in the direction of the retard position is supported on a retard stop that is separated from the locking element so that the locking element is relieved of load.

A known means for equalizing the differing speeds of adjustment and facilitating unlocking in the advance position are compression springs that are arranged in advance adjusting chambers with their torque acting in opposition to the frictional torque of the camshaft.

The generic document DE 197 26 300 A1 discloses a rotary piston adjuster for adjusting the angular position of the camshaft of an internal combustion engine. This adjuster comprises an outer rotor connected to a drive pinion and an inner rotor connected to the camshaft. The outer rotor comprises at least one hydraulic chamber with radial separating walls and the inner rotor possesses at least one pivoting vane that sealingly divides the hydraulic chamber into a working chamber A and a working chamber B and is hydraulically pivotable between a retard stop position and an advance stop position. A locking device enabling a detachable connection of the outer and inner rotors and at least one compression spring acting in opposition to the frictional torque of the camshaft are arranged between the two rotors. These compression springs that are arranged in the advance adjusting chambers at a distance from the inner periphery of the outer rotor are supported only in depressions of the radial separating walls and of the pivoting vanes. In this way, when the outer rotor pivots, a contact between the hard spring steel and the outer rotor and the wear resulting therefrom are avoided. A drawback of this arrangement is a possible instability of the compression spring that restricts its design relative to spring rigidity and length and thus also its potential functions.

OBJECT OF THE INVENTION

The object of the invention is to provide a rotary piston adjuster of the pre-cited type that permits a free design of the compression spring within broad limits and a low-wear operation with this spring.

SUMMARY OF THE INVENTION

The invention achieves the above object by implementing the features listed in the body of claim 1. The attachment offers enough room even for a compression spring that is longer than a hydraulic chamber of the rotary piston adjuster. A larger spring length permits a low spring rate that brings about a desired small increase of the spring force over the angle of pivot of the inner rotor. This is particularly important in the case of compression springs whose spring force is so large that they effect a strong support of the rotary piston adjuster on the advance stop and thus render a locking on the advance stop superfluous. The required stabilization of a long compression spring is enabled by the wear-resistant components of the attachment in which the compression spring is supported and guided. A pointwise support of the spring can additionally reduce wear.

Basically, it is also possible to use a flat coil spring that requires no support in place of a compression spring. However, due to its small shape efficiency factor, a flat coil spring with the same spring torque has a larger overall volume than a compression spring.

According to an advantageous feature of the invention, the attachment comprises an intermediate plate having a side washer and a cover as also a disc-shaped bushing that together form an end closure of the outer rotor on its end directed away from the camshaft. The fact that the attachment at the same time constitutes the end closure of the outer rotor leads to a saving of axial design space. The attachment can, however, also be arranged on the camshaft-side end of the outer rotor. In this case, the drive pinion is configured as an intermediate plate comprising a locking device and stops while its end directed away from the camshaft is closed with an additional cover.

For lodging the compression spring in the attachment, it is advantageous if the intermediate plate that is connected to the outer rotor comprises a coaxial bore whose periphery is configured with a circular segment-shaped recess having a radially extending end surface. The length of the circular segment-shaped recess can be chosen to correspond to the desired length of the compression spring.

An advantageous feature of the invention is that the disc-shaped bushing that is connected to the inner rotor is sealingly guided in the coaxial bore of the intermediate plate as well as between the side washer and the cover, and that a peg comprising at least one radially extending side surface is arranged on the outer periphery of the disc-shaped bushing for pivoting within the circular segment-shaped recess. According to another advantageous feature, the compression spring is supported in the circular segment-shaped recess on the radially extending end surface thereof and on the radially extending side surface of the peg and bears against the periphery of the circular segment-shaped recess. In this way, the compression spring is supported over its entire length and its spring torque loads the outer rotor through the intermediate plate and the inner rotor through the disc-shaped bushing.

According to still another advantageous feature of the invention, the cover comprises a groove-shaped indentation that laterally widens the circular segment-shaped recess and thus creates room for accommodating a compression spring having a circular turn cross-section. In this way, the compression spring is also laterally guided and thus achieves maximum shape stability.

If the radial height of the recess and the peg is larger than the turn diameter of the compression spring, this latter can bear not only against the periphery of the recess but, with the help of arc-shaped spacers, it can be installed with a smaller diameter. In this way and by varying the pre-stress of the compression spring, the spring torque can be adjusted. It is also conceivable to arrange two or more compression springs one on top of the other and separate their turns with interposed sheets. It is also imaginable to provide further recesses in the intermediate plate and further pegs for further compression springs connected in parallel. With all these possibilities, the spring torque of the compression spring can be varied within broad limits and adapted to the frictional torque of the camshaft or to a value above or below this.

If the compression spring is pre-bent into an arc shape and thus is already given the desired radius of curvature during fabrication, any additional stresses and radial forces that may arise due to shape deviations during the bending of straight compression springs and would act on the spring supports are avoided.

The groove-shaped indentation of the cover is rendered superfluous by using a different type of compression spring, viz., a compression spring with an oval turn cross-section having the same width as the intermediate plate. However, in this space-saving solution, it is no longer possible to vary the turn diameter of the compression spring.

In an alternative embodiment of the invention, a rotary piston adjuster comprises a lengthened hydraulic chamber in which at least one compression spring is arranged that is supported on a separating wall and on a pivoting vane as also, at least pointwise, on the inner periphery of an outer rotor. In this embodiment, even if a plurality of compression springs are arranged next to one another, no additional axial space is required. However, the outer rotor and the pivoting vane must be wear-resistant. Outside of the range of pivot of the pivoting vane, the inner periphery of the outer rotor can be configured so that contact with the compression spring is only pointwise. In this way, shape deviations of the compression spring that could promote wear no longer have a detrimental effect. If locking is effected by a slidable pivoting vane, this must not be loaded by the compression spring.

An adjusting device with an external stop and a compression spring arranged in one of the hydraulic chambers is also conceivable. Even a variant with an internal stop and a spring mounted externally in an attachment is possible. Irrespective of its arrangement, a compression spring having an appropriate pre-stress and direction of action can replace a locking device (e.g. a locking body or pin or vane). A uniform speed of adjustment of an adjuster with retard locking can likewise be realized both with an external and an internal arrangement of the spring. If there are locking or unlocking problems with an adjusting device that locks in the retard position, the compression spring can be installed so as to act in the retard direction. This gives support to the frictional torque of the camshaft which means that the speeds of adjustment differ even more than before. In this case, too, with an appropriate spring design, a locking device can be dispensed with.

Further features of the invention are disclosed in the claims, in the following description and in the drawings in which examples of embodiment of the invention are schematically represented.

BRIEF DESCRIPTION OF THE DRAWINGS

The invention will now be described with reference to some examples of embodiment. The appended drawings show.

DETAILED DESCRIPTION OF THE DRAWINGS

Figure 1:
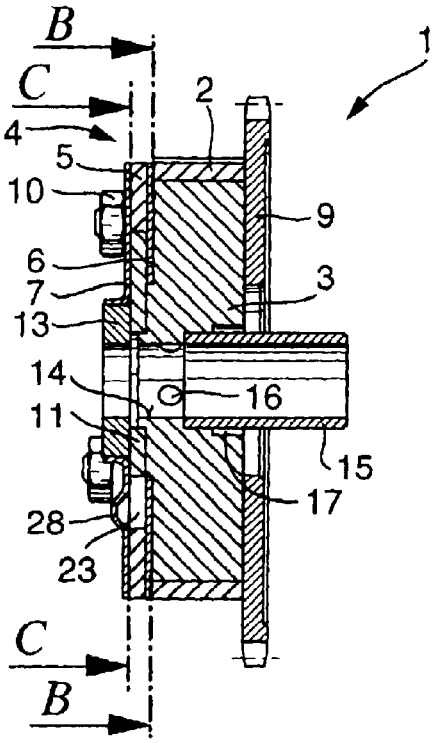
FIG. 1, the section A—A through a vane-type adjuster according to the invention shown in FIG. 2.
Figure 2:
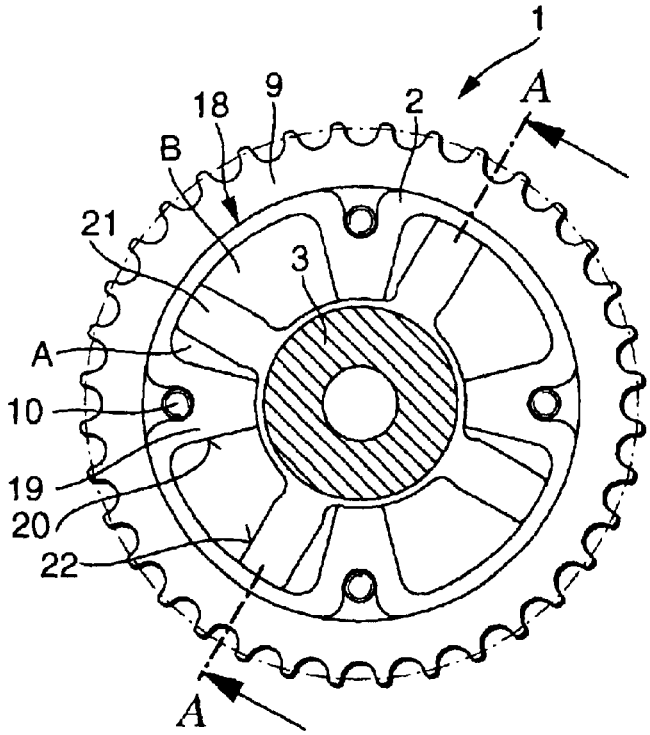
FIG. 2, the section B—B through the vane-type adjuster of FIG. 1.

FIG. 1 shows a longitudinal section A—A through a vane-type adjuster 1 of FIG. 2 having an outer rotor 2 and an inner rotor 3. On its end directed away from the camshaft, the outer rotor 2 comprises an attachment 4 having an intermediate plate 5 that is connected to a side washer 6 and a cover 7 and that, together with a disc-shaped bushing 11, forms an end closure of the outer rotor 2 on the end directed away from the camshaft. The closure of the outer rotor 2 on the end directed toward the camshaft is formed by a drive pinion 9. The intermediate plate 5, the side washer 6, the cover 7 and the drive pinion 9 are stayed together with the outer rotor 2 by screws 10. The disc-shaped bushing 11 is screwed to the inner rotor 3 through a sealing ring carrier 13 with a central screw, not shown. The sealing ring carrier 13 seals the rotary piston adjuster relative to the cover 7.

A sleeve 15 arranged in a stepped central bore 14 of the inner rotor 3 effects a separate oil supply through first ducts 16 to the working chambers A and through second ducts 17 to the working chambers B.

The cross-section B—B of FIG. 2 through the vane-type adjuster 1 of FIG. 1 shows the outer rotor 2 comprising hydraulic chambers 18 that are defined by separating walls 19 with radially extending side surfaces 20 and are sealingly divided into working chambers A and B by pivoting vanes 21 having parallel side surfaces 22. The pivoting vanes 21 are formed integrally on the inner rotor 3.

Figure 3:
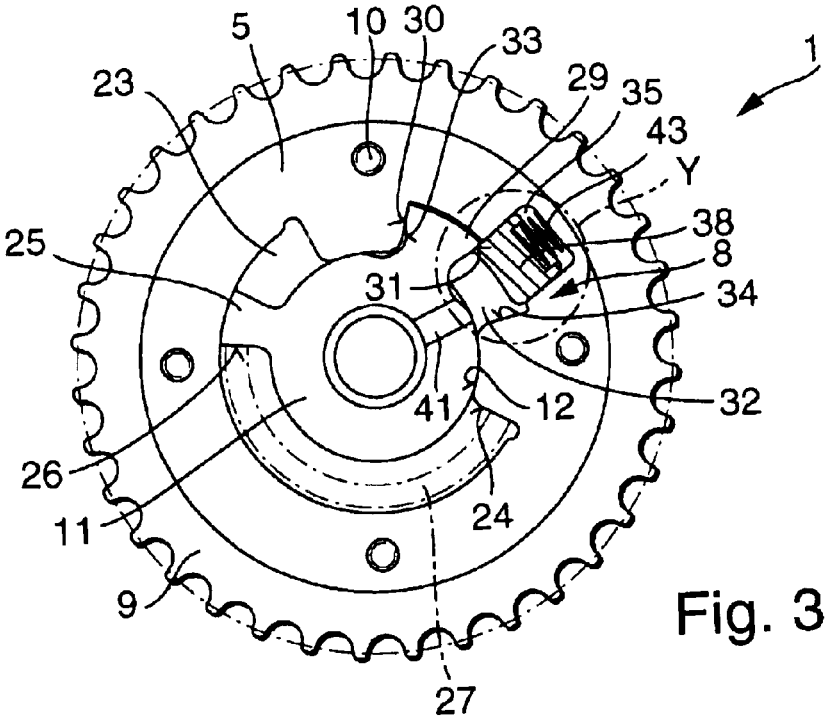
FIG. 3, the section C—C through an attachment of the vane-type adjuster of FIG. 1.
Figure 3A:
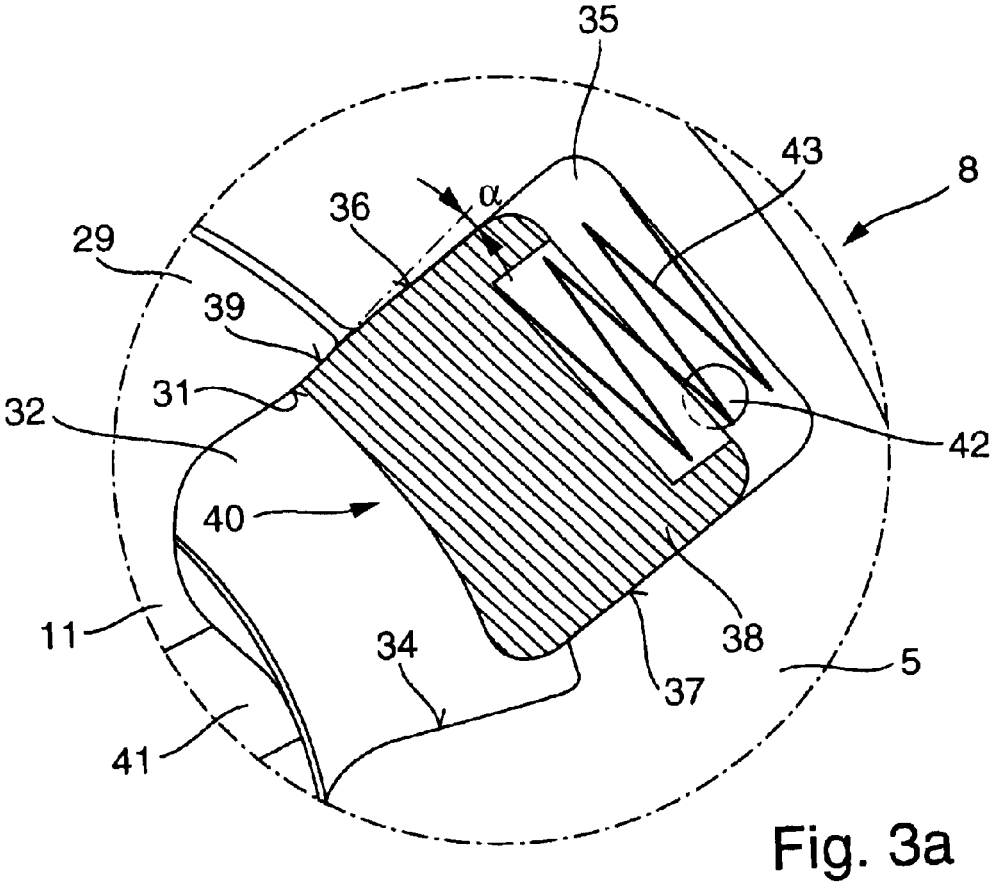
FIG. 3*a*, the enlarged detail Y of the locking device of FIG. 3.

FIG. 3 shows a cross-section C—C through the attachment 4 of the vane-type adjuster 1 of FIG. 1, while in FIG. 3*a*, the locking device 8 is shown in an enlarged representation. The intermediate plate 5 comprises a coaxial bore 12 on whose periphery a circular segment-shaped recess 23 having at least one radially extending end surface 24 is arranged. A peg 25 having at least one radially extending side surface 26 is arranged on the outer periphery of the disc-shaped bushing 11 for pivoting in the circular segment-shaped recess 23. A compression spring 27 that bears against the inner periphery of the recess 23 and exerts a torque on the inner rotor 3 through the peg 25 in direction of an advance stop, is arranged between the radially extending end surface 24 of the circular segment-shaped 23 and the radially extending side surface 26 of the peg 25. The compression spring 27 is pre-bent into an arc shape with the desired bending radius. In this way, any additional stresses and radial forces that may arise due to shape deviations during the bending of straight compression springs and would act on the spring supports are avoided.

Figure 4:
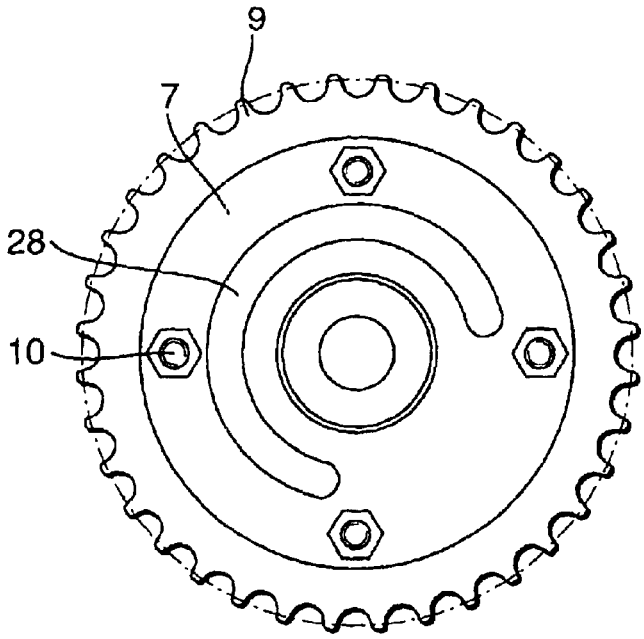
FIG. 4, a view of the end of the vane-type adjuster of FIG. 1 directed away from the camshaft.
Figure 3B:
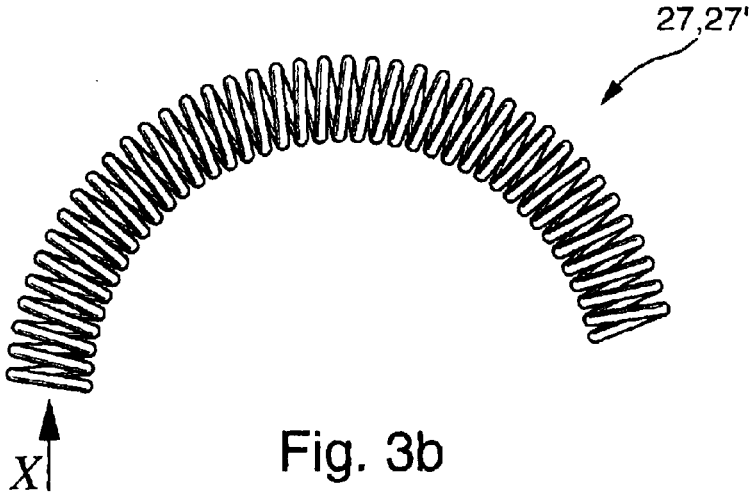
FIG. 3*b*, a pre-bent compression spring.
Figure 3C:
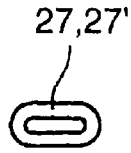
FIG. 3*c*, the view X of the pre-bent compression spring of FIG. 3*b;*

The compression spring 27' shown in FIG. 3*b* has an oval turn cross-section (see FIG. 3*c*) that fits into the width of the circular segment-shaped recess 23. If a spring with a normal circular turn cross-section is used, it protrudes at least on one side beyond the circular segment-shaped recess 23. This protrusion is accommodated by a groove-shaped indentation 28 of the cover 7 that widens the circular segment-shaped recess 23 (see FIGS. 1 and 4).

FIGS. 3 and 3*a* disclose that a second peg 29 having a first and a second radially extending side surface 30 and 31 is arranged on the periphery of the disc-shaped bushing 11 in a second circular segment-shaped recess 32 of the intermediate plate 5 for pivoting between the radially extending end surfaces of the second circular segment-shaped recess 32 that are configured respectively as a retard stop 33 and an advance stop 34.

The intermediate plate 5 comprises a radial guide groove 35 for a first and a second parallel guide surface 36, 37 of a locking body 38 that is loaded by a locking spring 43. When the internal combustion engine runs out and the second peg 29 bears against the retard stop 33 in the circular segment-shaped recess 32, the locking body 38 is pushed inward by the force of the locking spring 43 till a pressure contact is established between a pressure contact surface 39 of the locking body 38 and the second radially extending side surface 31 of the second peg 29. The direction of displacement of the locking body 38 forms an acute angle $\alpha$ with the second radially extending side surface 31 of the second peg 29. The force that acts on the second peg 29 in peripheral direction compensates the rotational lash between the crankshaft-mounted components and the camshaft-mounted components caused by assembling and wear conditions.

Due to the fact that the angle $\alpha$ included between the pressure contact surface 39 and the direction of displacement of the locking body 38 is situated at the borderline of self-locking (quasi self-locking), an unlocking of the locking body 38 under the influence of torque as well as a non-releasable clamping are prevented.

The spring-distal end 40 of the locking body 38 is in fluid communication with the working chamber A through a radial flow groove 41 of the disc-shaped bushing 11, and the spring-proximate end of the locking body 38 is in fluid communication with the working chamber B through a vent bore 42. This arrangement is suitable for a clamp-free unlocking of the locking body 38 of an inlet camshaft adjuster. This locking body is locked preferably on the retard stop in whose direction, upon starting of the engine, the inlet camshaft is loaded by its frictional torque and the locking body 38 is relieved of load. For an outlet camshaft adjuster, as a rule, a stepped locking body that is loaded by the oil pressure of the working chambers A and B is required for a clamp-free unlocking.

Because the radius of the spring-distal end 40 of the locking body 38 is larger than the outer radius of the disc-shaped bushing 11, only a friction-reducing line contact is established between the two surfaces.

In place of the two pegs 25, 29, it is also conceivable to provide only the second peg 29 that then additionally takes over the support of the compression spring 27. For this, the second peg 29 with its radially extending side surfaces 30, 31 must be correspondingly lengthened in radial direction.

Figure 5:
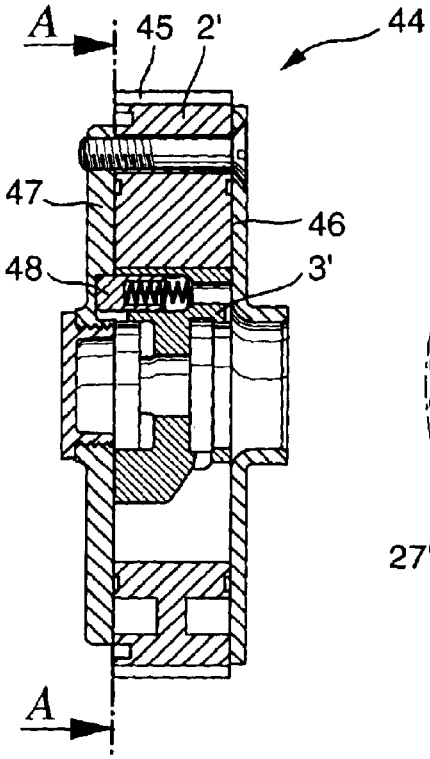
FIG. 5, the section B—B through a vane-type adjuster of FIG. 6.
Figure 6:
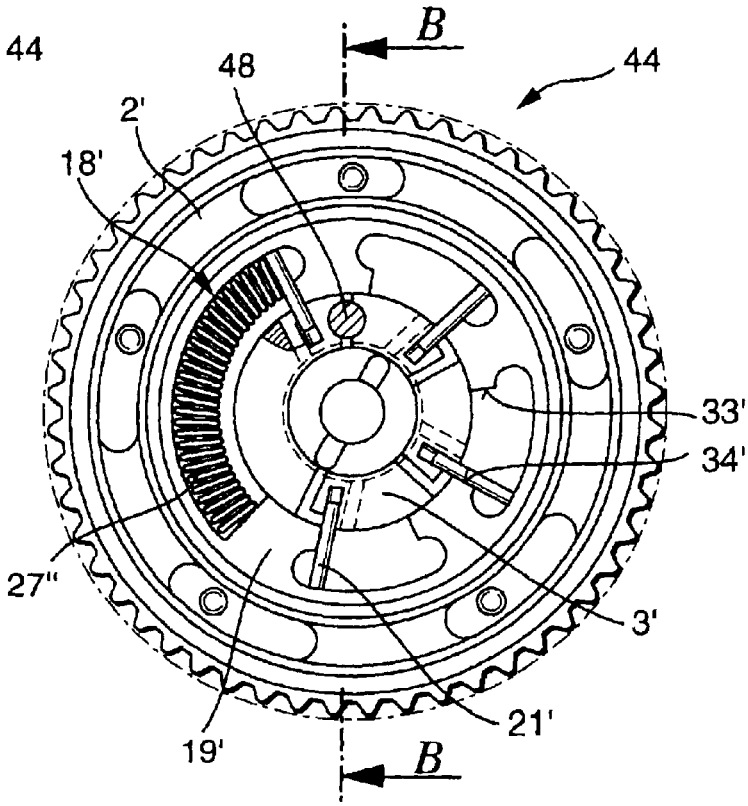
FIG. 6, the section A—A through the vane-type adjuster of FIG. 5 having a compression spring arranged in a lengthened hydraulic chamber.

FIG. 5 shows a cross-section B—B through a vane-type adjuster 44 represented in FIG. 6 comprising an outer rotor 2' whose outer periphery supports a gear 45 and whose ends are closed by a first and a second end cover 46, 47. A locking pin 48 is shown in a locked position in an inner rotor 3' that is connected to a camshaft, not shown.

FIG. 6 shows a cross-section A—A through the vane-type adjuster 44 of FIG. 5 comprising the outer rotor 2', separating walls 19' and the inner rotor 3' that comprises pivoting vanes 21'. The pivoting vanes 21' are hydraulically pivoted between an inner retard stop 33' and an inner advance stop 34' of the separating walls 19'. A compression spring 27" is arranged in a lengthened hydraulic chamber 18' where it is supported on the separating wall 19' and the pivoting vane 21' and bears against the inner peripheral surface of the outer rotor 2'.

The rotary piston adjuster of the invention is characterized by the fact that the compression spring 27, 27' that is arranged either externally in an attachment 4 or internally in a hydraulic chamber 18' effects a compensation of the frictional torque of the camshaft. This results in a uniform speed of adjustment of the camshaft in both directions of adjustment. If this criterion does not have priority, an appropriately designed and arranged compression spring 27, 27', 27" can replace the locking device in that it brings the inner rotor 3 to abut against the respective stop desired to be locked. Through the wedge effect of the locking body 38, the external locking device 8 enables a compensation of the rotational lash caused by assembling and wear conditions between the crankshaft-mounted components and the camshaft-mounted components in the locking position. In this way, rattling noises due to the alternating torque of the running-on and running-off camshaft are reliably and, by virtue of the wear-resistant configuration of the attachment 4, effectively avoided.

Moreover, the attachment 4 of the invention comprising the locking device 8, the retard and the advance stops 33, 34 and the compression spring 27 is suitable for mounting on any kind of rotary piston adjusters and also on camshaft adjusters based on the principle of orbital low-speed hydraulic motors.

List of reference numerals

| | |
|---|---|
| 1 | Vane-type adjuster |
| 2 | Outer rotor |
| 2' | Outer rotor |
| 3 | Inner rotor |
| 3' | Inner rotor |
| 4 | Attachment |
| 5 | Intermediate plate |
| 6 | Side washer |
| 7 | Cover |
| 8 | Locking device |
| 9 | Drive pinion |
| 10 | Screw |
| 11 | Disc-shaped bushing |
| 12 | Coaxial bore |
| 13 | Sealing ring carrier |
| 14 | Central bore |
| 15 | Sleeve |
| 16 | First duct |
| 17 | Second duct |
| 18 | Hydraulic chamber |
| 18' | Hydraulic chamber |
| 19 | Separating wall |
| 19' | Separating wall |
| 20 | Radially extending side surface |
| 21 | Pivoting vane |
| 21' | Pivoting vane |
| 22 | Parallel side surface |
| 23 | Circular segment-shaped recess |
| 24 | Radially extending end surface |

-continued

| List of reference numerals | |
|---|---|
| 25 | Peg |
| 26 | Radially extending side surface |
| 27 | Compression spring |
| 27' | Compression spring |
| 27" | Compression spring |
| 28 | Groove-shaped indentation |
| 29 | Second peg |
| 30 | First radially extending side surface |
| 31 | Second radially extending side surface |
| 32 | Second circular segment-shaped recess |
| 33 | Retard stop |
| 33' | Internal retard stop |
| 34 | Advance stop |
| 34' | Internal advance stop |
| 35 | Radial guide groove |
| 36 | First guide surface |
| 37 | Second guide surface |
| 38 | Locking body |
| 39 | Pressure contact surface |
| 40 | Spring-distal end |
| 41 | Radial flow groove |
| 42 | Vent bore |
| 43 | Locking spring |
| 44 | Vane-type adjuster |
| 45 | Gear |
| 46 | First end cover |
| 47 | Second end cover |
| 48 | Locking pin |

What is claimed is:

1. A rotary piston adjuster for adjusting the angular position of the camshaft of an internal combustion engine, said adjuster comprising and outer rotor connected to a drive pinion and an inner rotor connected to the camshaft, the outer rotor comprising at least one hydraulic chamber having radial separating walls and the inner rotor comprising at least one pivoting vane that sealingly divides the hydraulic chamber into working chambers A and B and can pivot hydraulically between an advance stop position and a retard stop position, and a locking device suitable for detachably connecting the outer and inner rotors and at least one compression spring acting in opposition to the frictional torque of the camshaft being arranged between the two rotors, wherein the compression spring (27, 27') is arranged in an attachment (4) that is connected to the rotary piston adjuster and comprises an intermediate plate (5) having a side washer (6) and a cover (7), which attachment supports the compression spring (27, 27') at least pointwise over its entire length and, together with a disc-shaped bushing (11) forms an end closure of the outer rotor (2) on its end directed away from the camshaft the intermediate plate (5) is connected to the outer rotor (2) and comprises a coaxial bore (12) on whose periphery a circular segment-shaped recess (23) having a radially extending end surface 24 arranged.

2. A rotary piston adjuster according to claim 1, wherein the disc-shaped bushing (11) is connected to the inner rotor (3) while being sealingly guided in the coaxial bore (12) of the intermediate plate (5) and between the side washer (6) and the cover (7).

3. A rotary piston adjuster according to claim 2, wherein a peg (25) comprising at least one radially extending side surface (26) is arranged on the outer periphery of the disc-shaped bushing (11) for pivoting in the circular segment-shaped recess (23).

4. A rotary piston adjuster according to claim 3, wherein the compression spring (27) is supported in the circular segment-shaped recess (23) on the radially extending end surface (24) of the circular segment-shaped recess (23) and on the radially extending side surface (26) of the peg (25) while bearing against the periphery of the circular segement-shaped recess (23).

5. A rotary piston adjuster according to claim 4, wherein the cover (7) comprises a groove-shaped indentation (28) that laterally widens the circular segment-shaped recess (23) for receiving the compression spring (27).

6. A rotary piston adjuster according to claim 5, wherein the compression spring (27, 27') is preferably pre-bent into an arc shape.

7. A rotary piston adjuster according to claim 6, wherein the compression spring (27') has an oval turn cross-section corresponding to the width of the intermediate plate (5).

8. A rotary piston adjuster claim 1, wherein the rotary piston adjuster comprises a lengthened hydraulic chamber (18') in which at least one preferably pre-bent compression spring (27") is arranged that is supported on a separating wall (19') and on a pivoting vane (21') as also, at least pointwise, oil the inner periphery of the outer rotary (2').

* * * * *

UNITED STATES PATENT AND TRADEMARK OFFICE

CERTIFICATE OF CORRECTION

PATENT NO. : 6,769,386 B2
DATED : August 3, 2004
INVENTOR(S) : Jens Schäfer

It is certified that error appears in the above-identified patent and that said Letters Patent is hereby corrected as shown below:

Title page,
Item [75], Inventors, please change "Jens Shafer" to read -- Jens Schäfer --

Signed and Sealed this

Twenty-first Day of December, 2004

JON W. DUDAS
*Director of the United States Patent and Trademark Office*